United States Patent [19]

Reiner et al.

[11] 4,265,449

[45] May 5, 1981

[54] SIMULATED BOWLING GAME

[75] Inventors: Lawrence L. Reiner, Woodbury, N.Y.; Michael Marra, Huntington, Conn.; Michael F. Hennig, Fort Lee, N.J.

[73] Assignee: Louis Marx & Co., Inc., Stamford, Conn.

[21] Appl. No.: 876,788

[22] Filed: Feb. 10, 1978

[51] Int. Cl.[3] ..... A63D 3/00

[52] U.S. Cl. ..... 273/41; 273/85 G

[58] Field of Search ..... 273/41, 101.2, 126 A, 273/127 R, 316, 85 G

[56] References Cited

U.S. PATENT DOCUMENTS

| | | | |
|---|---|---|---|
| 2,536,538 | 1/1951 | Cronk | 273/41 |
| 2,643,884 | 6/1953 | Koci | 273/41 |
| 2,652,252 | 9/1953 | Alexander | 273/41 X |
| 2,656,189 | 10/1953 | Price | 273/126 A |
| 2,845,270 | 7/1958 | Durant | 273/101.2 |
| 4,008,893 | 2/1977 | Yoseloff | 273/37 |

*Primary Examiner*—Anton O. Oechsle

*Attorney, Agent, or Firm*—Blum, Kaplan, Friedman, Silberman & Beran

[57] ABSTRACT

A simulated bowling game wherein a reflected image of fixed illuminated ten pin shaped lamps is provided. A plurality of fixed illuminated bowling pin lamps are disposed in a ten pin pattern and are each normally illuminated to produce an image representative of a bowling pin. A semi-reflective surface is positioned at an incline with respect to a bowling alley, and is further positioned in facing relationship with respect to the plurality of illuminated bowling pin lamps so that the semi-reflective surface produces an image of each of the illuminated bowling pin lamps at the other end of the bowling alley. A plurality of contacts are positioned in a predetermined pattern at a rear end of the bowling alley and are adapted to produce contact signals when contacted by the bowling ball. Control circuitry is coupled intermediate the respective contacts and each of the illuminated bowling pin lamps to receive each of the contact signals produced by the contacts when a ball is rolled toward the rear end of the alley and in response thereto is adapted to selectively deenergize certain of said illuminated bowling pins and thereby prevent same from producing a reflected illuminated image.

13 Claims, 8 Drawing Figures

SIMULATED BOWLING GAME

BACKGROUND OF THE INVENTION

This invention is directed to a simulated bowling game, and in particular to a simulated bowling game wherein a reflected image of fixed illuminated bowling pin shaped lamps is utilized to simulate an actual bowling alley.

Heretofore, toy bowling games have been of two types. A first type is where the bowling pins are actually contacted by a projectile such as a small bowling ball or a sliding puck. Such bowling games have been found to be less than completely satisfactory for two reasons. First, the toy bowling pins can often be damaged by the projectile, and secondly, the toy bowling pins do not effectively simulate the manner in which actual bowling pins are knocked down. In order to overcome the disadvantages provided by bowling games wherein the toy bowling pins are contacted by the moving projectile, simulated bowling games having a display panel to which are mounted a number of transilluminated visual indicia corresponding to bowling pins have been provided. In these types of simulated bowling games, the player rolls a ball down an alley so that the ball will pass under a display panel and actuate a series of downwardly extending switches, which switches in turn indicate the pins "knocked down" by switching off the appropriate visual indicia on the display panel. Among the disadvantages of this type of simulated bowling game is that display panels are incapable of providing the same effect provided by ten bowling pins standing at the end of a bowling alley and, additionally, the transilluminated visual indicia are directly coupled to the switches that are contacted by the bowling ball and, accordingly, prevent a simulated known down of bowling pins that are not directly contacted by the bowling ball, but would otherwise be knocked down in an actual bowling alley as a result of the angle at which an actual bowling pin disperses when same is struck by a bowling ball. Accordingly, a simulated bowling game that overcomes the aforenoted disadvantages is desired.

SUMMARY OF THE INVENTION

Generally speaking, in accordance with the instant invention, a simulated bowling game wherein a reflected image of ten illuminated bowling pins and the manner in which same would be deflected if struck by an actual bowling ball is provided. The simulated bowling game includes a bowling alley and a bowling pin assembly at a rear end of the bowling alley toward which a bowling ball is adapted to be rolled from a front end of the alley. The bowling pin assembly is characterized by a plurality of illuminated bowling pin lamps disposed in a ten pin pattern, each of said bowling pin lamps being adapted to be illuminated to produce an image representative of a bowling pin. A semi-reflective surface, positioned at an incline with respect to said alley, is spaced apart from the alley to provide a clearance for the ball and is further positioned in facing relationship with respect to the plurality of illuminated bowling pin lamps so that the semi-reflective surface produces an image of each of the illuminated bowling pin lamps at the front end of the bowling alley. A plurality of contact switches are positioned at the rear end of the alley and are adapted to selectively produce contact signals when a bowling ball is brought into contact therewith. A control circuit is disposed intermediate the respective contact switches and the plurality of illuminated bowling pin lamps for receiving each of the contact signals produced by the respective contacts when a ball is rolled toward the rear end of the alley and, in response thereto, selectively deenergize certain of the illuminated bowling pin lamps representative of the bowling pins that have been knocked down by the bowling ball engaging the contact switches.

Accordingly, it is an object of the instant invention to provide an improved simulated bowling game.

A further object of the instant invention is to provide a simulated bowling game wherein a reflective image of a ten pin arrangement is viewed by the bowler at the front end of the bowling alley.

Still a further object of the instant invention is to provide a simulated bowling game wherein the bowling pin need not strike a simulated bowling pin or a contact directly associated therewith in order to simulate the knocking down of each bowling pin.

Still another object of the instant invention is to provide a bowling game wherein the manner in which actual bowling pins are knocked down and in which the same scoring utilized in an actual bowling game is effectively simulated thereby.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
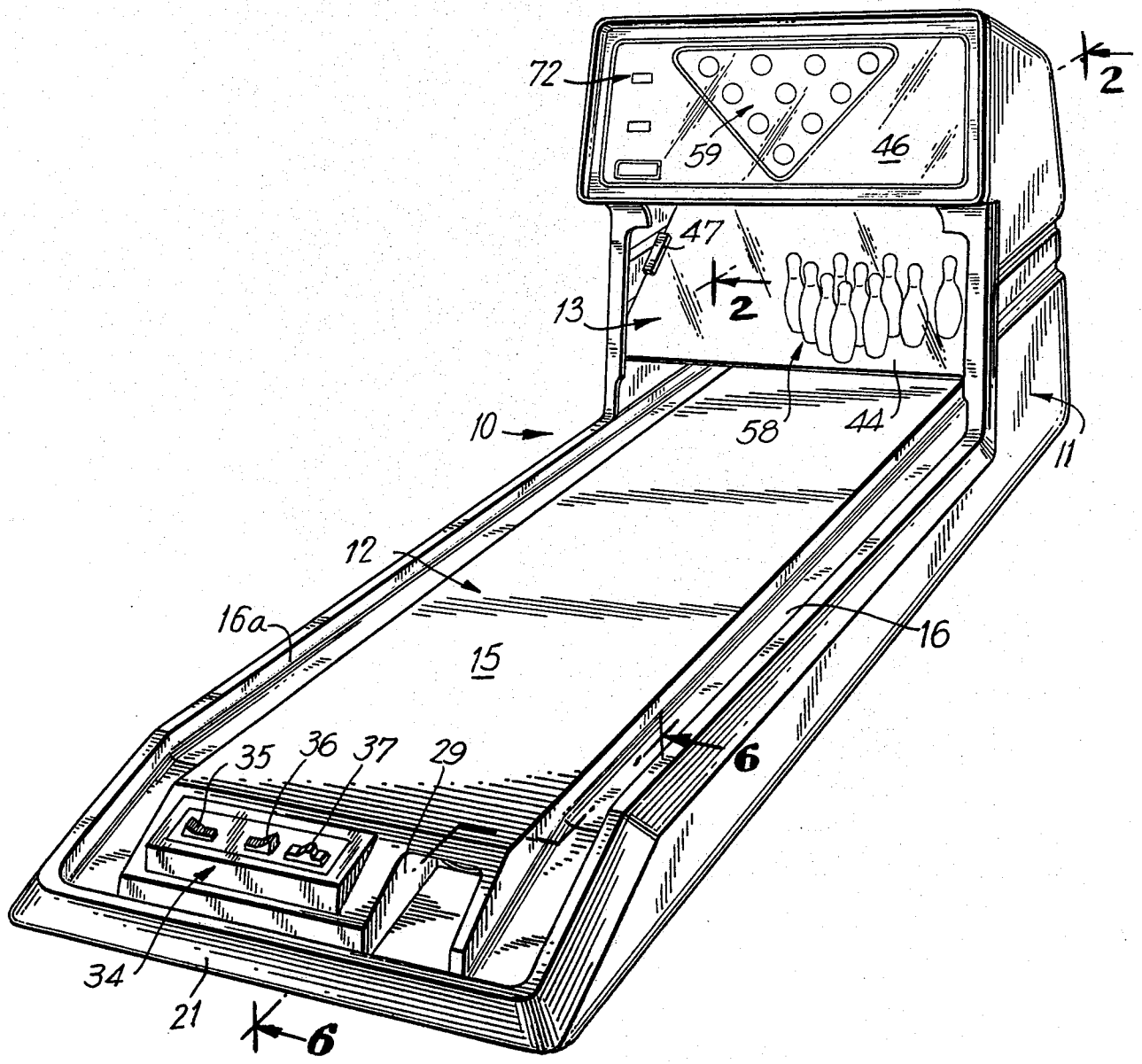
FIG. 1 is a perspective view of a simulated bowling game constructed in accordance with a preferred embodiment of the instant invention.
Figure 2:
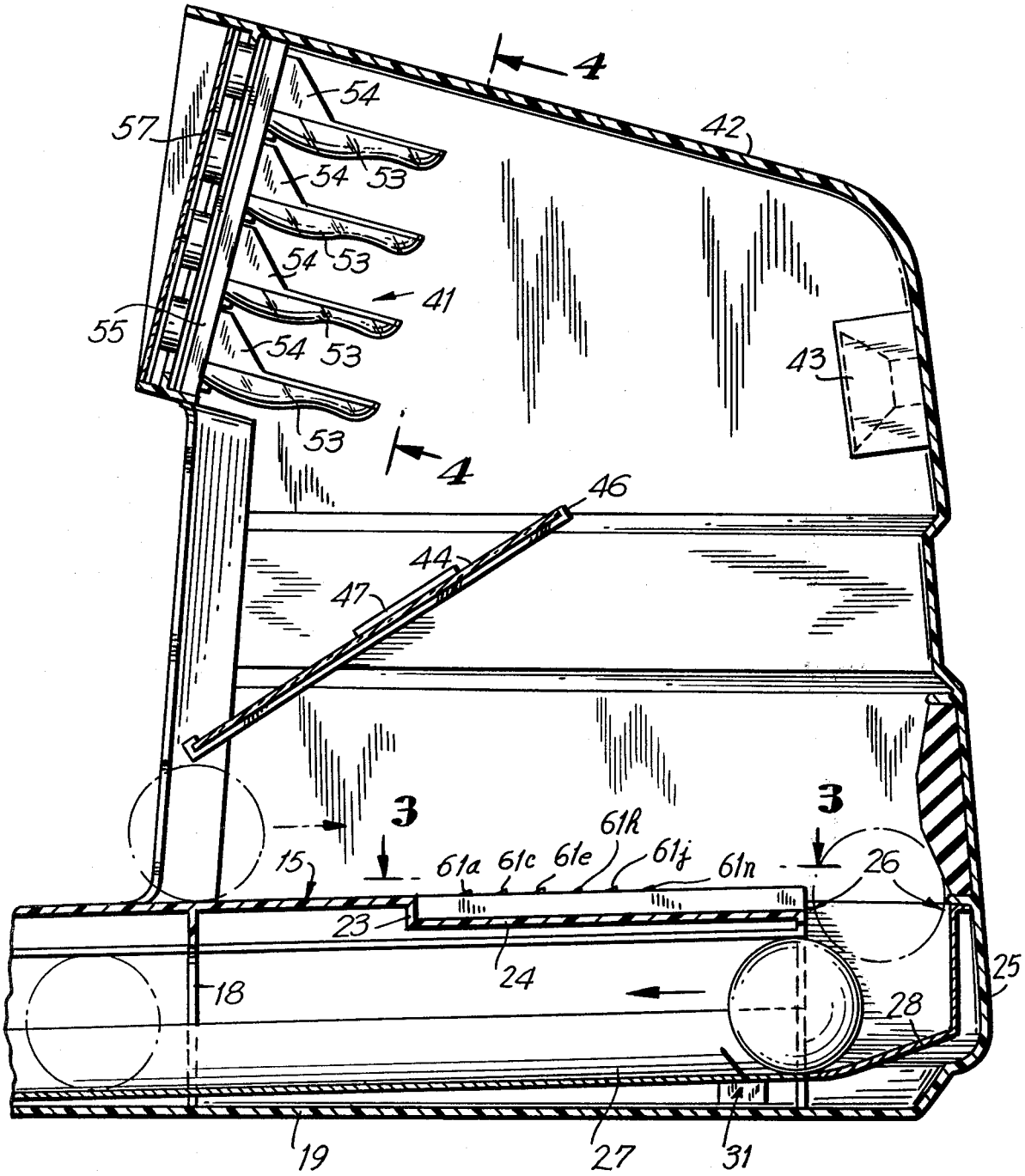
FIG. 2 is a sectional view taken along line 2—2 of FIG. 1.
Figure 3:
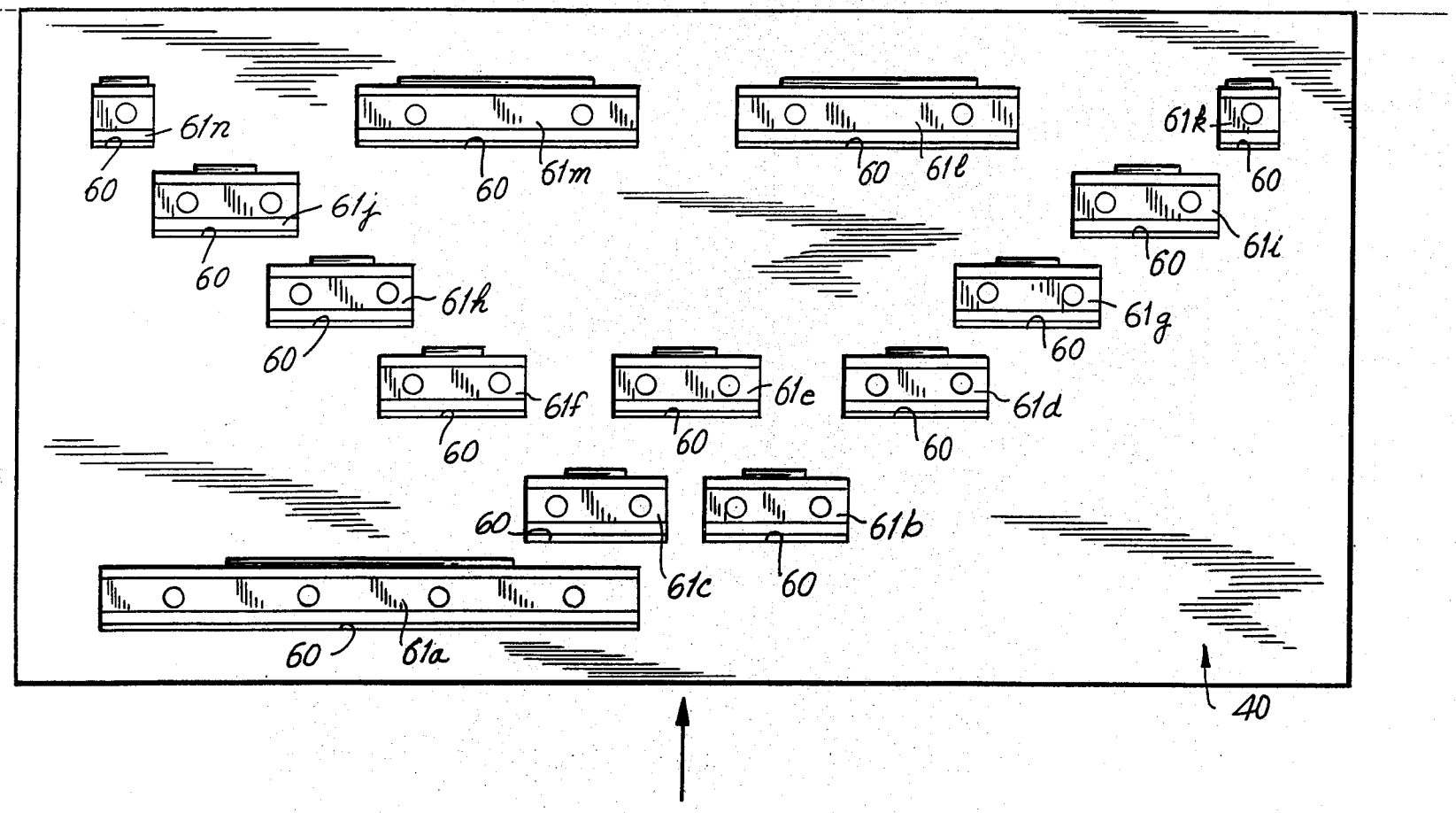
FIG. 3 is a plan view taken along line 3—3 of FIG. 2.

Reference is now made to FIG. 1, wherein a simulated bowling game, generally indicated as 10, is depicted. The simulated bowling game is supported in a housing 11 defining an alley assembly, generally indicated as 12, and a bowling pin assembly, generally indicated as 13. As is particularly illustrated in FIGS. 1, 2, 6 and 7, the alley assembly 12 includes a substantially flat elongated alley 15 having recessed gutters 16 and **16*a*** respectively extending along the lengthwise edge of both sides of the alley and operating in the same manner that a gutter would operate in an actual bowling alley.

Alley 15 and gutters 16*a* and 16*b* are integrally formed into the housing and are supported by lengthwise struts 17, widthwise struts 18, bottom wall 19 and side walls 20, front wall 21 and rear wall 25.

A recessed step 23 is provided at the rear end of the alley and defines a recessed support surface 24 for supporting a contact assembly, generally indicated as 40. As is explained in greater detail below, contact assembly 40 positions a plurality of treadle contact switches in a position substantially flush with alley 15 in order to permit certain of the contact switches to be actuated by a bowling ball when same is projected toward the rear end of the alley. Accordingly, the contact assembly 40 and support surface 24 terminate at a position spaced apart from rear wall 25 to define an elongated return opening 26 at the rearmost portion of the alley assembly. Return opening 26 extends along the entire widthwise extent of the alley portion for receiving a bowling ball after same has rolled past the contact assembly 40. An elongated metal chute, generally indicated as 27, has an inclined receiving portion 28 for receiving a bowling ball when same falls through the opening 26 and for directing the bowling ball into the elongated chute 27. Chute 27 is angled downwardly, as it extends to the front of the alley assembly, and delivers the bowling ball to the end of the alley return opening 29 disposed in the front wall 21 of the alley to thereby automatically return the bowling ball after each bowling operation.

A leaf-type microswitch, generally indicated as 31, is disposed at the position where the receiving portion 28 is connected to the chute 27. The microswitch is positioned to assure that it is actuated each time the bowling ball is rolled from the front end to the rear end of the alley assembly and is returned by the chute 27.

The alley assembly also includes a switching station, generally indicated as 34, supported in the inclined front wall 21 of the alley. The switching station 34 supports on-off switch 35, player mode switch 36 and reset switch 37, which switches are utilized to control the operation of the simulated bowling game in a manner to be discussed in greater detail below.

Specific reference is now made to FIGS. 1 through 5, wherein the bowling pin assembly, generally indicated as 13, is illustrated in detail. In addition to the contact assembly 40, the bowling pin assembly includes an upright housing 42 that supports a fixed illuminating lamp assembly 41, a loudspeaker 43, a display panel 57 and a semi-reflect glass plate 44. Semi-reflective glass plate 44 is supported at an incline with respect to the substantially planar surface of the alley 15, and is further positioned in facing relationship with respect to the fixed illuminating lamp assembly 41. Specifically, a bracket 46, including a clip 47, is supported on both sides of the pin housing 42 in order to position securely semi-reflective glass plate 44 in the manner noted above and also at a position spaced apart with respect to the substantially planar surface of alley 15 in order to permit a sufficient clearance for the bowling ball to roll under the glass plate and engage the contact assembly 40.

Figure 4:
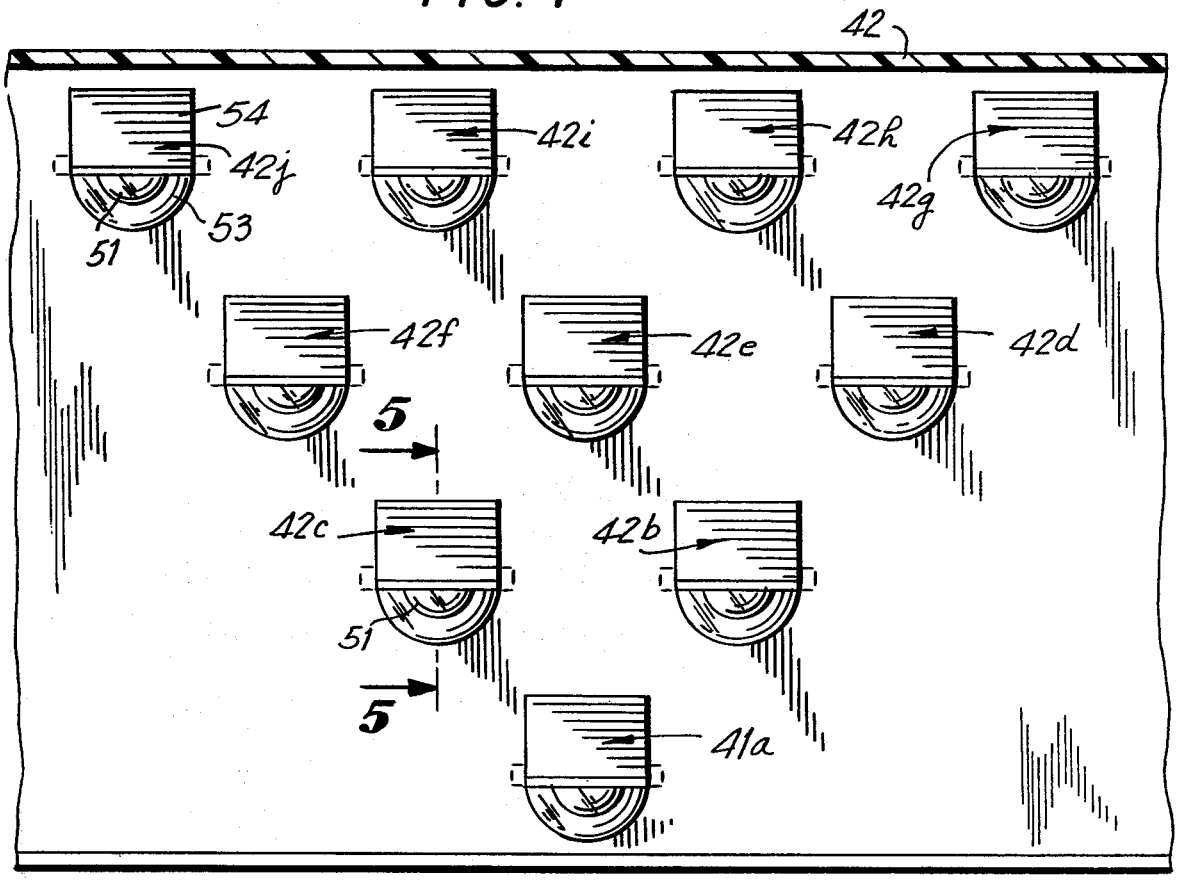
FIG. 4 is a sectional view taken along line 4—4 of FIG. 2.
Figure 5:
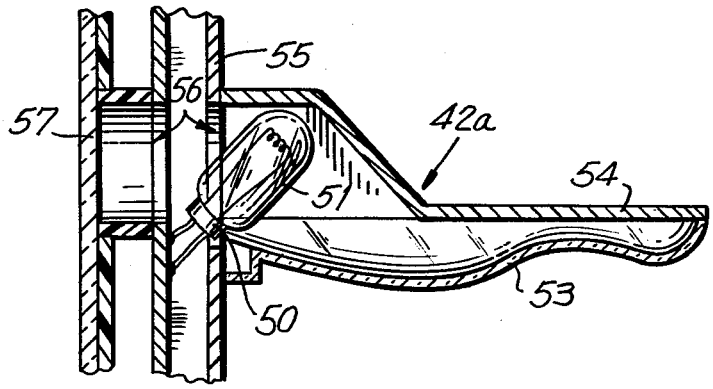
FIG. 5 is a sectional view taken along line 5—5 of FIG. 4.
Figure 6:
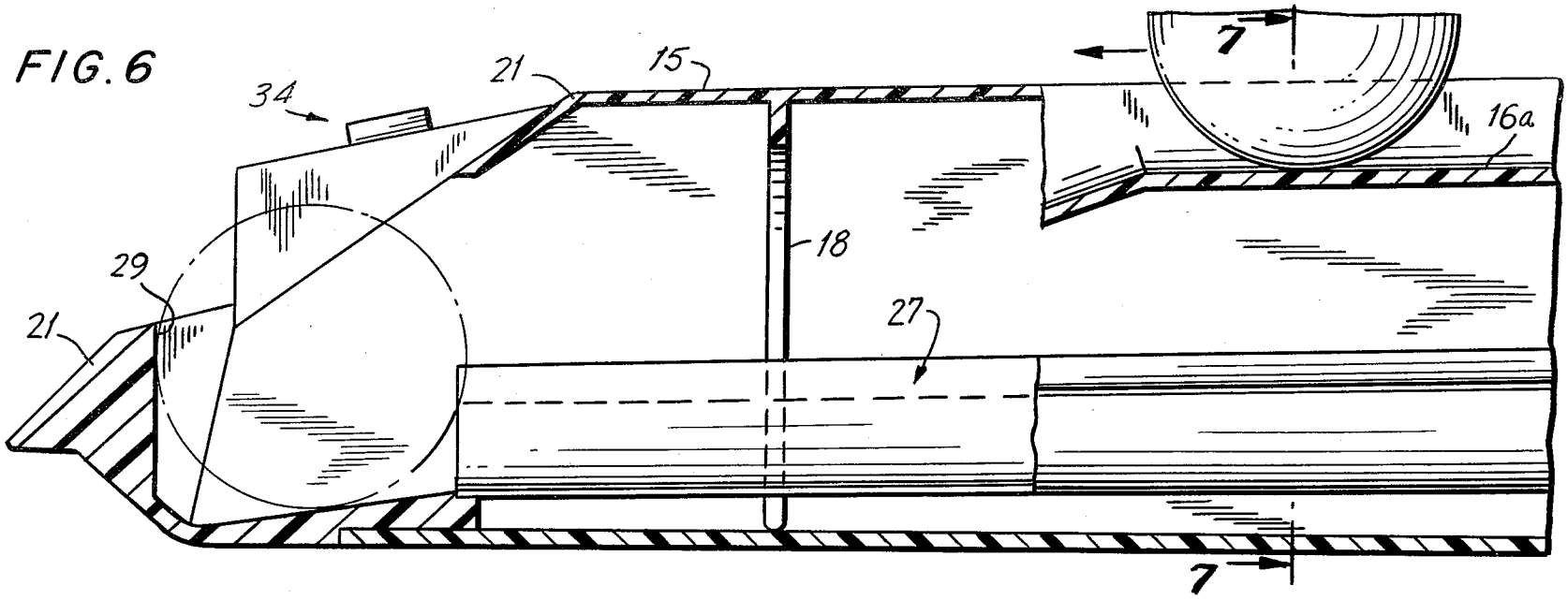
FIG. 6 is a sectional view taken along line 6—6 of FIG. 1.
Figure 7:
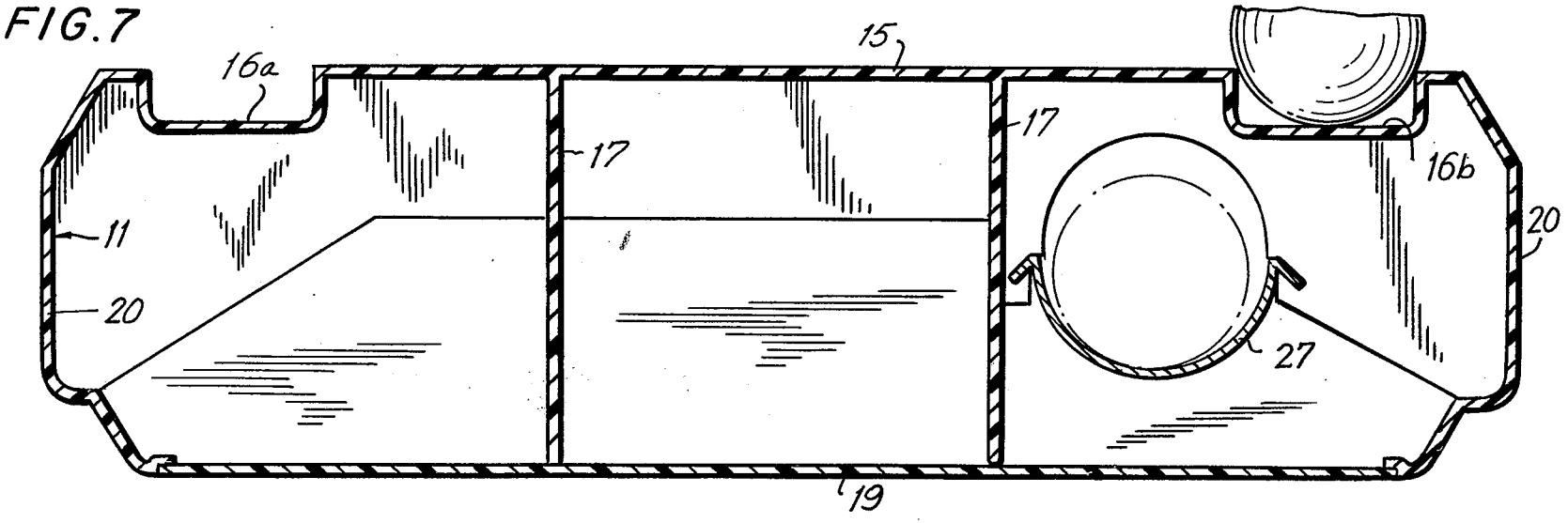
FIG. 7 is a sectional view taken along line 7—7 of FIG. 6.

The fixed illuminating lamp assembly is comprised of ten fixed illuminating lamp bowling pin fixtures 42*a* through 42*j* disposed in a ten pin pattern, best illustrated in FIG. 4. Each fixed illuminating lamp bowling pin fixture includes a socket 50 supported on a panel 55 for receiving a light bulb 51. Each flashlight bulb is disposed in the lamp fixture supported on the panel and is comprised of a translucent plastic bowling pin shaped lens 53 secured to an opaque rear member 54. The plastic shaped lens is disposed between the light bulb 51 and the semi-reflective glass plate in order to reflect the image of the plastic shaped lens 53 off the semi-reflective glass plate. An opening 56 is formed in the panel 55 proximate each flashlight bulb to provide a light path to the front of the display panel 57 in order to effect a lighting of the display panel 57 at the same time that a bowling pin image is produced in light being directed through the translucent plastic bowling pin shaped lens 53. Accordingly, when each of the fixed illuminating lamp bowling pin fixtures 42*a* through 42*j* are energized, the bowling pin images produced thereby are reflected by the semi-reflective glass plate 45 to produce a three dimensional ten pin image, generally indicated in FIG. 1 as 58, at the front end of the alley to be viewed by the person playing the bowling game. Also, as aforenoted, the triangular ten pin display 59, positioned on the display panel 57, displays each of the ten bowling pin positions and when each of the ten pins are to be displayed as standing, permits each of the ten circular lights to be lit to represent same. Moreover, when a bowling ball has been rolled into contact with the contact assembly to thereby simulate the knocking down of pins, as is described in detail below, certain of the light bulbs 51, representative of the bowling pins knocked down, will be deenergized thereby leaving a reflected image representative of only the pins left standing. The construction of the illuminating lamp assembly 41 will further permit the triangular display 59 in the display panel 57 to illustrate the bowling pins knocked down and the bowling pins left standing, which indication will correspond to the image reflected by the semi-reflective glass plate.

Figure 8:
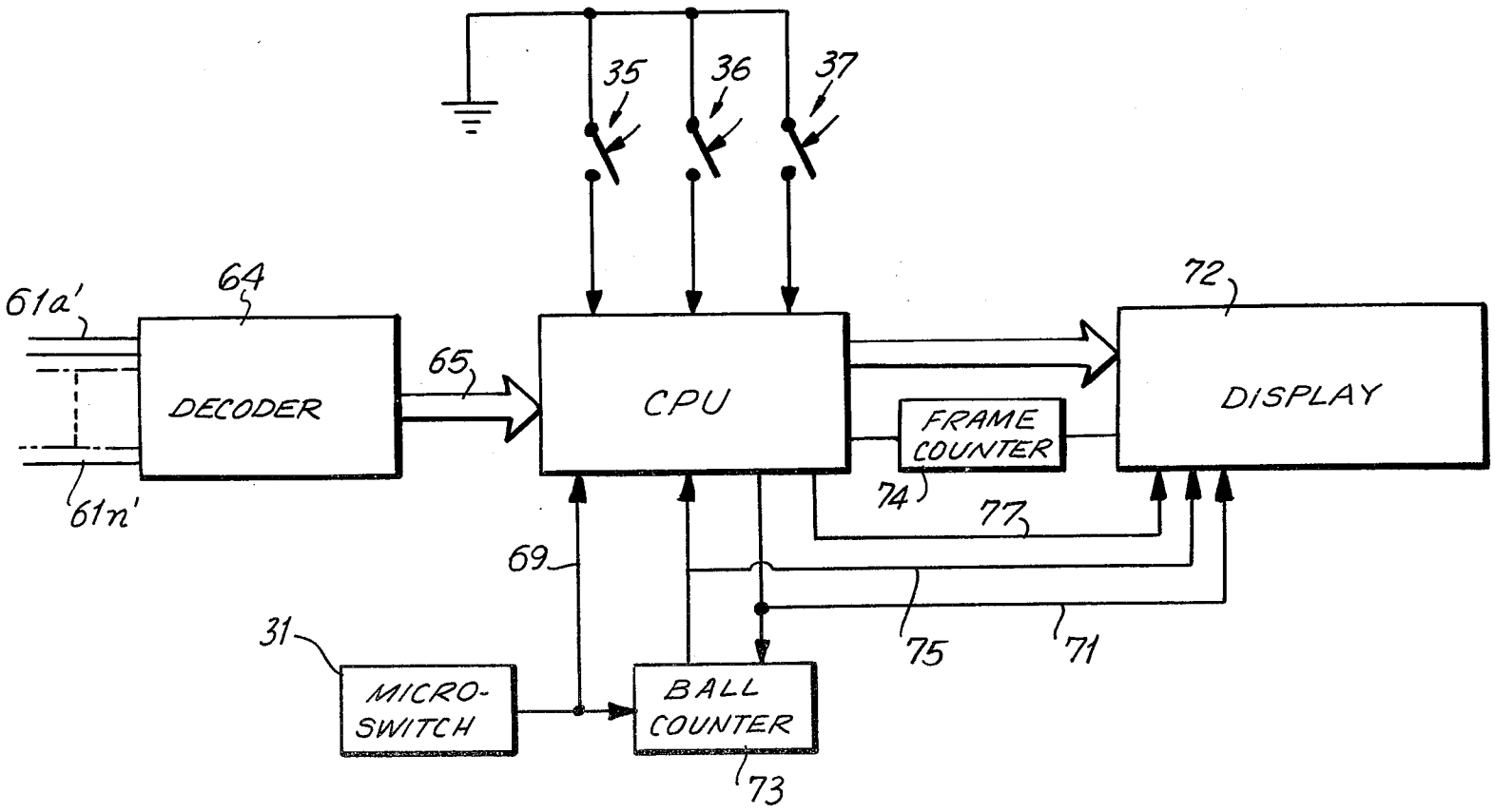
FIG. 8 is a block circuit diagram of the microprocessor control circuitry of the instant invention.

As aforenoted, the contact assembly 40 includes a plurality of treadle contact switches 61*a* through 61*n*, each extending through an appropriate sized opening 60 formed in a surface 62 of the contact assembly, which surface is flush with the planar surface of the alley. The plurality of treadle contact switches 61*a* through 61*n* are disposed in a predetermined pattern on the surface 62. Additionally, the contact assembly 40 includes a micro-processor chip, which chip houses all of the control and scoring circuitry of the simulated bowling game. As is illustrated in FIG. 8, each treadle contact switch, 61*a* through 61*n*, is adapted to produce contact signals 61*a'* through 61*n'*, respectively when a bowling ball is rolled from the forward end to the rear end and comes into contact therewith. Accordingly, unless the ball falls into the gutters 16, on each side of the alley, at least some of the contact switches are engaged by the ball to thereby produce contact signals in response thereto.

A decoder circuit 64 is adapted to receive each of the contact signals produced by the respective contact switches and in response thereto applies a decoded control signal 65 to a central processing unit, hereinafter "CPU", generally indicated as 67. CPU 67 is programmed in order to simulate the scoring and performance of an actual bowling game for one or two players. Accordingly, once manually operated switch 35 is closed, to thereby apply power to the micro-processor, a single player mode or double player mode is selected by respectively leaving manually operated switch 36 open or closed. If, for example, a single player mode is selected by disposing switch 36 in an open position, the turning on of the power by on-off switch 35 effects a resetting of the micro-processor circuitry to zero and places the simulated bowling game in a one player, first frame condition. At this time all of the fixed illuminating lamp bowling pin structures are lit to produce a full ten pin reflected image. The bowler now begins the game by rolling a ball from the forward end to the rear end of the alley. When the bowling ball is rolled, one of three possibilities can occur. The first possibility is that the ball will fall into the gutter and thereby not strike any of the treadle switch contacts 61*a* through 61*n* and, hence, no contact signals will be applied to the decoder 64. The second condition is that the ball will strike certain of the treadle switch contacts 61*a* through 61*n*, and thereby produce a sequence of contact signals representative of less than all ten pins being knocked down. The third condition is a "strike" condition wherein the appropriate treadle switch contacts in the pattern, illustrated in FIG. 3, will be contacted by the bowling ball to thereby register a "strike" condition representative of all of the pins being knocked down. Accordingly, the absence of any signals applied to the decoder as a result of a gutter ball or, alternatively, a combination of signals representative of the second or third bowling conditions is applied as decoded control signal 65 to CPU 67 and is read and processed thereby when the bowling ball is returned through the return chute 27 and strikes the leaf-type microswitch 31 disposed in the chute. Specifically, microswitch 31 applies a read signal 69 to the CPU 67 in order to read the control signal 65 produced by the decoder 64 and, additionally, indexes the ball counter in order to apply a signal to the CPU 67 to be prepared for the bowling of the second ball in the frame. The CPU 67, in response to receiving the read signal 69, applies deenergizing signals to the appropriate illuminating bowling pin lamps 47*a* through 47*j*, to thereby simulate the number of pins that were knocked down by the rolling of the bowling ball. Thus, if the first condition were detected by the CPU 67, no deenergizing signal is applied to any of the fixed illuminating lamp bowling pin structures 42*a* through 42*j*. Conversely, if a strike condition were detected by the treadle switch contacts 61*a* through 61*n*, all of the lights would be deenergized and, additionally, a strike signal 71 would be applied to the display 72 in order to demonstrate that a strike has been thrown and would also be applied to the ball counter 73 to effect a resetting of same. If, however, the condition occurs wherein the control signal 65, produced by treadle switch contacts 61*a* through 61*n*, represents a number between 0 and 10 pins being knocked down, the CPU 67 will apply an appropriate deenergizing signal to the illuminating lamp assembly and thereby deenergize the appropriate number of fixed illuminating lamp bowling pin fixtures representative of the number of pins knocked down.

Thus, a coordinate effect is produced by the deenergization of certain of the fixed illuminating lamp bowling pin fixtures 47*a* through 47*j*. Specifically, as each fixed lamp fixture is deenergized, the image of the specific bowling pin represented thereby will not be viewed by the viewer at the front end of the alley and, additionally, the triangular ten pin display panel 59 will illustrate which of the bowling pins have been knocked down by the first roll of the bowling ball.

A frame counter 74 is coupled to the CPU 67 and to the display 72. Accordingly, the frame counter is reset to one at the beginning of each bowling game and, unless all of the pins are knocked down on the first roll of the bowling ball, the frame counter 74 is not indexed. When the first ball is rolled, unless the third condition noted above occurs, namely a strike is thrown, the frame counter 74 will not be indexed and, accordingly, the display 72 will continue to display frame 1. Additionally, in the absence of the occurrence of a strike condition, the contact switch 31 indexes the ball counter 73 which ball counter, in addition to indexing the CPU 67 to a second ball condition, also applies a second ball signal 75 to the display 72 to thereby advise the bowler of this condition. Moreover, once the ball counter 73 places the CPU 67 in a second ball condition, a memory and register in the CPU 67 determines that a second ball is to be thrown and, hence, instructs the CPU 67 to ignore certain of the contact signals produced by the treadle contact switches 61*a* through 61*n* when the second ball is thrown.

In order to simulate the operation of an actual bowling alley if, for example, only the seven pin is left standing after the first ball is thrown, only fixed lamp structure 42*j* will remain lit after the first ball is thrown. In an actual bowling alley, a second roll of the bowling ball on a straight line through the head pin would not knock down the seven pin. Accordingly, the CPU 67 includes a memory and programmable register that are reprogrammed in response to the ball counter applying a second ball signal 75 thereto, in order to ignore the actuation of certain of the treadle switch contacts when the second ball is rolled into contact therewith. Thus, by way of example, if the seven pin is to be knocked down by the second roll of the bowler, the ball would be required to actuate at least treadle contact switches 61*a*, 61*j* and 61*n* to thereby assure that contact signals 61*a*', 61*j*' and 61*n*' are applied to the decoder circuit. Contact signals 61*a*', 61*j*' and 61*n*' would be read by the CPU 67 when the microswitch 31 applies read signal 69 to the CPU 67. When the contact switches noted above are actuated the microswitch 31 applies read signal 69 to the CPU 67. In response to the read signal, the CPU 67 will read the decoded control signal 65 and deenergize the light bulb 51 disposed in the fixed illuminating lamp bowling pin fixture 42*j* and thereby complete a darkening of all of the fixed illuminating lamp bowling pin structures to produce a reflected image representative of all of the bowling pins having been knocked down. Simultaneously, a spare signal 77 will be applied to the display 72 to produce an indication that a spare has been thrown. After the second ball is thrown, the frame counter 74 will be indexed to provide a frame count signal 78 to the display 72, illustrating that it is now the second frame. Also, the ball counter 73 will be reset to thereby illustrate that the first ball of the second frame is to be thrown and, in the absence of a second ball signal 75 applied to the display, the display will once again indicate that a first ball is to be thrown. It is noted that the display 72 includes a further scoring display for illustrating the cumulative score obtained by the bowler, which score is computed by the CPU 67 in the same manner as the score would be totaled during an actual bowling game. It is noted that such automatic scoring means have been provided in toy bowling games and, hence, the scoring mechanism and the manner in which same is controlled by the CPU 67 is not within the scope of the instant invention. Additionally, the CPU 67 can also be programmed to accommodate the possibility that it will be necessary to throw three balls in the tenth frame when a strike or spare is thrown in that frame.

As noted above, when player mode switch 36 is closed, the CPU 67 is programmed to permit two players to compete and to store and display the competitive scores of both players. Similarly, the reset switch 37 is provided for permitting the bowler to recall pins standing and score of the previous frame if in a one player mode, or the other players pins standing and score in a two player mode, by applying a reset signal to the CPU 67.

As aforenoted, the CPU 67 provides a different deenergizing signal to the illuminating lamp assembly on the second ball. However, in addition to deenergizing certain of the illuminated bowling pin lamps in a predetermined pattern, the CPU 67 is programmed to randomly energize or deenergize certain of the fixed illuminating lamp bowling pin structures in order to simulate the variety of results that are accomplished in an actual bowling game. Thus, considerations such as pin vibrations, deflection angle and other effects accomplished in an actual bowling game are taken into account by programming the CPU 67 in an appropriate manner.

Accordingly, the simulated bowling game of the instant invention accurately simulates an actual bowling game in terms of scoring and play action, without requiring the toy pins to be actually struck by the bowling ball. Moreover, by not directly coupling the contact switches disposed in the alley and by forming same in a random pattern, of the type depicted in FIG. 3 of the instant application, the CPU 67 can be programmed to simulate the actual results that would be obtained in a real bowling alley were the bowling ball to be rolled along the same path with respect to the orientation of the ten pins.

A 2 inch 8Ω speaker is mounted on the rear wall of upright housing 42 and is used to simulate the sounds of pins falling. Specifically, the digital deenergization pulses applied to the specific fixed illuminating lamp structures are also applied to the loudspeaker to thereby increase the noise in correspondence with increased number of pins knocked down.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. In a simulated bowling game including a bowling alley and a bowling pin means at a rear end of said alley toward which a bowling ball is adapted to be rolled from a front end of the alley, the improvement comprising bowling pin means including a plurality of fixed illuminating bowling pin means disposed in a ten pin pattern, each of said fixed illuminating bowling pin means being adapted to be illuminated and produce a bowling pin image, a surface that is at least partly-reflective at an incline with respect to said alley, said partly-reflective surface being spaced apart from said alley to provide a clearance for said ball and further disposed in facing relationship with respect to said plurality of illuminated bowling pin means so that said partially-reflective surface can produce a reflective illuminated image of each of said illuminating bowling pin means at said front end of said alley, a plurality of electrical contact means positioned in a predetermined pattern at the rear end of said alley, each of said contact means being adapted to produce a contact signal when a bowling ball is displaced into contact with same, and control circuit means for receiving each of said contact signals produced by said contact means when a ball is rolled toward said rear end of said alley and in response thereto is adapted to selectively deenergize certain of said fixed illuminating bowling pin means to thereby prevent a reflective image of same from being produced, a display panel being disposed proximate to said plurality of fixed illuminating bowling pin means disposed in a pattern, and said panel being positioned intermediate each of said fixed illuminated bowling pin means and the front end of said bowling alley, to thereby provide a display coordinated with the image of the fixed illuminating bowling pins off the reflective surface.

2. A simulated bowling game as claimed in claim 1, wherein said predetermined pattern of contact means is positioned at substantially the same distance from the front end of said alley as the appearance of upright illuminated images of the pins reflected off of said partially reflective surface that are associated with the position of the contact means.

3. A simulated bowling game as claimed in claim 1, wherein each said fixed illuminating bowling pin means is a lamp fixture including a translucent lens in the shape of a bowling pin and a light bulb, said lens being disposed intermediate said reflective surface and said light bulb.

4. A simulated bowling game as claimed in claim 3, wherein said lamp fixture is constructed and arranged to position said light bulb so that said light produced thereby is directed towards said reflective surface disposed in facing relationship therewith and is also directed toward said display panel to effect a coordinate display of said image reflected off said reflective surface.

5. A simulated bowling game as claimed in claim 1, wherein the electrical contact means includes a plurality of treadle contact switches disposed in accordance with the pattern depicted in FIG. 3.

6. A simulated bowling game as claimed in claim 1, wherein said alley includes a return chute, said return chute including a widthwise opening disposed at the rear end of said alley for receiving the bowling ball after same has passed the predetermined pattern of contact means, said return means including a track disposed under said alley for returning said ball to the front end of said alley.

7. A simulated bowling game as claimed in claim 6, and including a switch means disposed in said return chute for detecting when said ball is returned by said return chute, said switch means being coupled to said control circuit means for applying an actuator signal to said control circuit means to process each of said contact signals produced by each of the respective contact means after the ball has been rolled into contact therewith.

8. A simulated bowling game as claimed in claim 7, wherein said control circuit means in response to receiving said actuation signal is adapted to selectively apply deenergizing signals to certain of said fixed illuminating bowling pin means in order to deenergize same in response to the sequence of contact signals applied thereto.

9. A simulated bowling game as claimed in claim 8, wherein said control circuit means in response to the sequence and number of contact signals applied thereto being adapted to deenergize certain of said illuminating bowling pin means in one of a random and predetermined pattern in order to simulate a variety of results obtained in an actual bowling game.

10. A simulated bowling game as claimed in claim 8, wherein said control circuit means includes decoder circuit means for receiving each of said contact signals and for producing a decoded contact control signal in response thereto, a central processing means for receiving said decoded contact control signal and said actuation signal and in response thereto for applying deenergizing signals to certain of said fixed illuminating bowling pin means.

11. A simulated bowling game as claimed in claim 10, and including ball counter means for receiving each actuation signal produced by said switch means and in response thereto remaining indexed after said previous ball is rolled, said ball counter means being adapted when indexed to apply a further ball signal to said central processing means, said central processing means being adapted to be reprogrammed in response to said further ball signal and in response thereto, deenergized each of said illuminating bowling pin means in a pattern that is different from the pattern of said illuminating bowling pin means deenergized in response to the previous ball rolled.

12. A simulated bowling game as claimed in claim 11, wherein said central processing means is adapted to apply a reset signal to said ball counter means to reset same when all of the fixed illuminating bowling pin means are deenergized by said central processing unit.

13. A simulated bowling game as claimed in claim 12, wherein said central processing means is adapted in response to said further ball signal being applied thereto to deenergize said fixed illuminating bowling pin means in one of a random and predetermined pattern in order to simulate a variety of results likely to occur in an actual bowling game.

* * * * *